United States Patent [19]

Bartolini

[11] 3,983,777

[45] Oct. 5, 1976

[54] SINGLE FACE, HIGH ASYMMETRY VARIABLE RELUCTANCE PICKUP FOR STEEL STRING MUSICAL INSTRUMENTS

[76] Inventor: William Bartolini, 1593 Sunset Drive, Livermore, Calif. 94550

[22] Filed: Feb. 28, 1975

[21] Appl. No.: 554,111

[52] U.S. Cl. ..... 84/1.15; 84/1.16

[51] Int. Cl.[2] ..... G10H 3/00

[58] Field of Search ..... 84/1.14–1.16, 84/1.01

[56] References Cited

UNITED STATES PATENTS

| | | | |
|---|---|---|---|
| 2,175,325 | 10/1939 | Sunshine | 84/1.16 X |
| 2,262,335 | 11/1941 | Russell | 84/1.16 |
| 2,817,261 | 12/1957 | Fender | 84/1.16 |
| 2,896,491 | 7/1959 | Lover | 84/1.16 X |
| 2,911,871 | 11/1959 | Schultz | 84/1.15 |
| 3,236,930 | 2/1966 | Fender | 84/1.15 |
| 3,483,303 | 12/1969 | Warner | 84/1.15 |
| 3,715,446 | 2/1973 | Kosinski | 84/1.16 X |
| R25,728 | 2/1965 | Freeman | 84/1.15 X |

FOREIGN PATENTS OR APPLICATIONS

| | | | |
|---|---|---|---|
| 1,176,145 | 1/1970 | United Kingdom | 84/1.16 |

*Primary Examiner*—Ulysses Weldon
*Attorney, Agent, or Firm*—David E. Newhouse

[57] ABSTRACT

A single face, variable reluctance pickup for steel string musical instruments is described which provides a highly asymmetrical magnetic field for preferentially sensing and generating electrical signals responsive to string vibrations perpendicular to the string plane. The described pickup features a single permanent bar magnet, common shaping faces, oriented parallel the string plane and perpendicular the strings and a plurality of sensing circuits having cores which magnetically and mechanically couple the shaping faces and the bar magnet. The described pickup provides a magnetic field in the string plane having a large flux gradient perpendicular the string plane and a minimum flux gradient parallel the string plane. The pickup is insensitive to "bending" and provides electronically amplified musical instruments with tonal characteristics similar to the tonal characteristics of acoustic string instruments.

21 Claims, 7 Drawing Figures

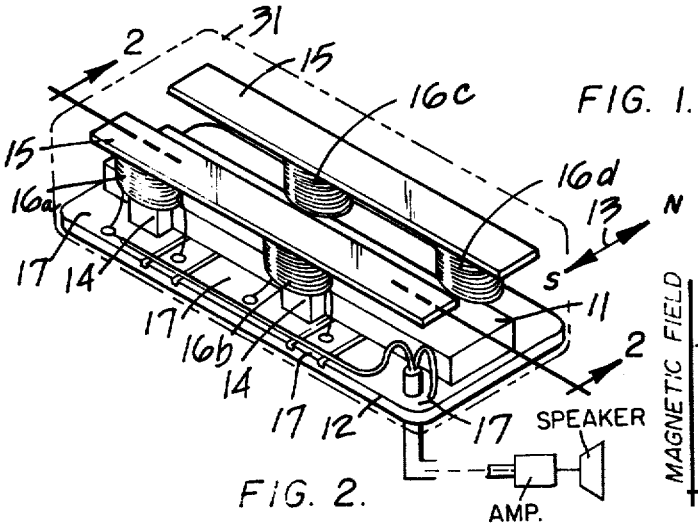
FIG. 1.
FIG. 2.
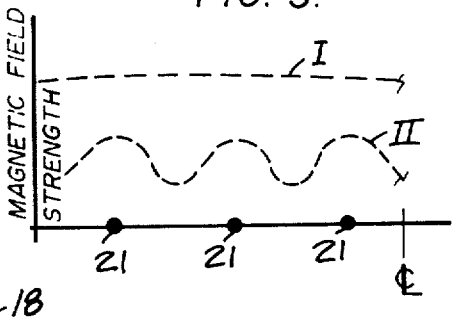
FIG. 3.
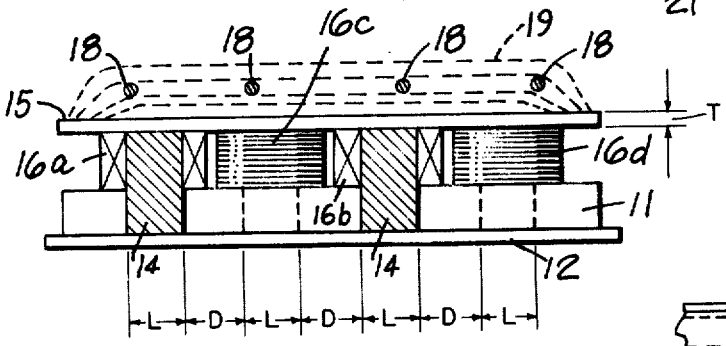
FIG. 5.
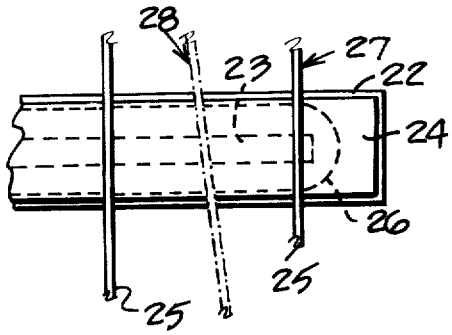
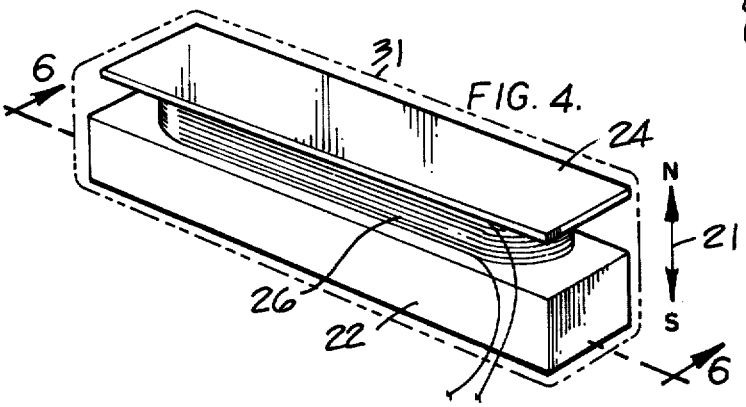
FIG. 4.
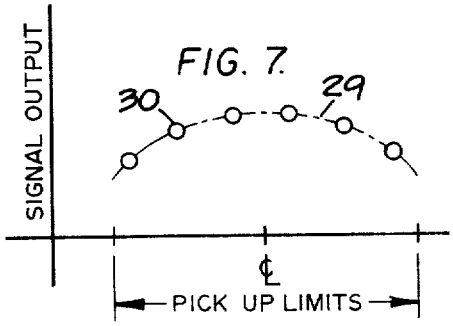
FIG. 7.
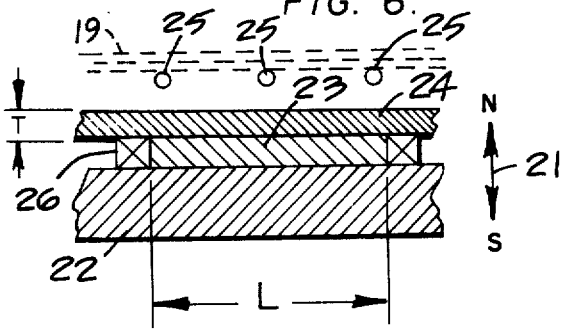
FIG. 6.

SINGLE FACE, HIGH ASYMMETRY VARIABLE RELUCTANCE PICKUP FOR STEEL STRING MUSICAL INSTRUMENTS

BACKGROUND OF THE INVENTION

1. Field of the Invention

The invention relates to a variable reluctance pickup for steel string musical instruments in which the vibrating strings cause variations of reluctance in a magnetic circuit generating electrical signals which, upon electronic amplification, are suitable for driving acoustic speaker systems.

2. Description of the Prior Art

Generally, variable reluctance pickups for steel string musical instruments comprise an arrangement of magnets and magnetically susceptible materials which establish a magnetic circuit in combination with the playing strings. As the strings vibrate, the changes in their position affect the reluctance and magnetic flux of the magnetic circuit. A sensing coil is inductively linked to the magnetic circuit for converting the variations in magnetic flux into a corresponding electrical signal. The electrical signals from the sensing coils is amplified electronically and fed into an acoustic speaker system for producing musical sounds.

There are many different configurations of the basic elements of variable reluctance pickup systems for steel string instruments. For example, U.S. Pat. No. 2,235,983 (Demuth) describes the basic elements of a magnetic pickup suitable for pianos and the like. U.S. Pat. No. 3,066,567 (Kelly) describes a magnetic pickup system having a single, permanent magnetic element with a plurality of pedestals to provide a specific pickup zone for a given instrument string in combination with a single sensing coil. U.S. Pat. No. 3,483,303 (Warner) describes a variable reluctance transducer pickup system for steel string musical instruments in which an attempt is made to isolate the magnetic circuits formed by adjacent strings so as to minimize "cross-talk" between the various strings. U.S. Pat. No. 3,571,483 (Davidson) describes a variable reluctance pickup system having a plurality of isolated magnetic circuits, each specifically designed to be substantially insensitive to the plane of string vibration. Finally, U.S. Pat. No. 3,715,446 (Kozinski) describes a magnetic pickup system having a balanced coil assembly for each string wherein each assembly includes a bar magnet supporting two circular pole pieces and two sensing coils disposed around the pole pieces.

Before discussing the disadvantages of prior art, variable reluctance pickup systems, it is instructive to review the fundamental properties of string instruments which give them their characteristic tones.

Basically, the tone of a plucked or a struck string instrument is judged by the richness and complexity of the acoustic output in the "attack" or beginning portion of a note. In acoustic string instruments, the bridge structure constrains the motion of the soundboard such that those components of string motion which are perpendicular to the plane of the soundboard are well amplified, while those components of the string motion which are parallel to the plane of the soundboard are not. The path described by any arbitrarily small segment of a smoothly released, plucked string is a precessing elliptical orbit of decreasing radius which rotates about the quiescent position of the string. Accordingly, the asymmetrical amplification of string motion provided by the bridge of an acoustic instrument yields a rich, full and complex tone of continuously varying, harmonic content. The richness and complexity of tones produced by acoustic string instruments are the primary criterion of judging the quality of such instruments.

In addition, the preferential or asymmetrical amplification provided by the bridge structure in acoustic string instruments enhances the expressive ability of the instrument. Specifically, the musician can control the initial motion of the string by plucking either parallel to the soundboard for a "thin or nasal" tone or perpendicular to the soundboard for a "full or rich" tone.

Steel string guitars and other similar instruments have a particular capability which distinguishes them from most other Western musical instruments. This capability is referred to as "bending". "Bending" is accomplished after a string is fretted and plucked by moving the fretting finger with the string across the fingerboard, stretching the string. The stretching of the string during "bending" can raise the pitch of the note by as much as seven semi-tones, a factor which greatly enhances the expressive capability of the instrument. However, "bending" a note also results in a large displacement of the string from its normal vibrating zone about the quiescent string position.

For variable reluctance pickup systems to have good tone (by acoustic instrument standards), it must be highly asymmetrical in converting string motion to electrical signal output. Further, such pickup systems have a capability for high-frequency response in order to preserve the richness and fullness of the varying harmonics in the "attack" portion of a note. Finally, for steel string guitars and similar instruments, the pickup systems must be insensitive to string displacement due to "bending".

The prior art variable reluctance pickup systems are characterized by separate pole tip and/or pole pieces for each string. Each pole tip and/or pole piece provides a distinct magnetic field region around the quiescent position of each string. The distinct magnetic field regions of prior pickup systems render them relatively insensitive to the plane of vibration of the particular string.

For example, pickup systems with circular pole pieces provide a magnetic field having the form of a symmetrical sinusoidal shell and a string vibrating within such a magnetic field will generate approximately equal magnitude electrical signals for string vibrations both parallel and perpendicular to the string plane.

Another disadvantage of the prior art variable reluctance pickup systems relates to their sensitivity to "bending". Specifically, the magnetic field drops off between the individual pole tip and/or pole pieces. Accordingly, the pickups will not uniformly sense a string vibration as the string is displaced from its normal vibrating position during a "bending" motion.

Prior art variable reluctance pickup systems having a single coil for sensing variations of the magnetic circuits have very poor high-frequency responses. Specifically, the impedance of a sensing coil in a magnetic circuit increases with increasing frequency up to a maximum at a resonant frequency whereupon the impedance of the coil decreases. Below the resonant frequency, the impedance of the coil is dominated by inductive effects. In explanation, the resulting variations in magnetic flux due to string vibrations induce an electrical signal in the coil which, in turn, creates another magnetic field which "bucks" or opposes the variations in flux induced by the string (Lenz' Law). This effect "impedes" the signal and increases with increasing frequency. Above the resonant frequency, the impedance is influenced by the capacitive effects between turns of the coil and between layers in the coil winding, i.e., the changing current in one turn of the coil influences current in neighboring turns of the coil. This effect becomes larger with increasing frequencies such that the coil behaves as a capacitive reactance with turn-to-turn capacitive leakage to ground. Accordingly, the output signal from the sensing coil falls off rapidly above the self-resonant frequency. Both the inductances and the cpacitance of a sensing coil vary linearly with the mean radius of the coil. The mean radii in single-coil embodiments of prior art variable reluctance pickups are large. Hence, the "attack" portion of a note is not reproduced accurately.

SUMMARY OF THE INVENTION

The invented variable reluctance pickup for steel string musical instruments provides a highly asymmetrical magnetic field for preferentially sensing string vibration perpendicular to the string plane and sounding board and generates representative electrical signals which, upon electronic amplification and input into an acoustic speaker system, produce tones or notes analogous to those produced by purely acoustical string instruments.

The invented pickup system includes a common magnetic circuit for all strings in the string plane formed by a single permanent bar magnet, common shaping faces composed of magnetically susceptible materials disposed proximate and parallel to the string plane, core elements composed of magnetically susceptible materials for magnetically and mechanically coupling the respective shaping faces to the poles of the bar magnet and a plurality of sensing coils, each disposed around one of the core elements, electrically connected in series. The shaping faces shape the magnetic field region, encompassing the string plane to provide a large magnitude magnetic flux gradient, in a direction perpendicular to the string plane and a small magnitude magnetic flux gradient in a direction parallel to the string plane (parallel to the soundboard).

The invented variable reluctance pickup system, because of the common shaping faces, uniformly senses a string vibration as it is displaced from its normal vibrating location during a "bending" motion.

Further, the combination of common shaping faces and series connection of the sensing coils provide a single magnetic circuit, capable of sensing and generating an electrical signal, corresponding to simultaneous vibrations of different strings in the string plane.

The primary object of the invented high asymmetry, variable reluctance pickup system is to produce an electronic signal which, upon amplification and input into an acoustic speaker system, generates a tone of constantly-changing, harmonic content at its leading edge, yielding the rich and complex attack normally expected of the best acoustic instruments.

Another primary object of the invented high asymmetry, variable reluctance pickup system relates to providing a pickup which is insensitive to "bending".

Still further objects, advantages and novel features of the invented high asymmetry, variable reluctance pickup system will become apparent upon examination of the accompanying figure and detailed description of a preferred embodiment thereof.

DESCRIPTION OF THE FIGURES

FIG. 1 is a perspective view of an embodiment of a single face, high asymmetry variable reluctance pickup having two common shaping faces.

FIG. 2 is a view taken along line 2 — 2 of FIG. 1 with dotted lines showing the summed magnetic field lines provided by the pickup.

FIG. 3 is a graph showing the magnetic field strength along a line perpendicularly oriented across a string plane above a pickup system. Curve I represents the field strength provided by the invented pickup shown in FIG. 1 and Curve II represents a magnetic field strength provided by conventional prior art pickups.

FIG. 4 is an embodiment of a single face, high asymmetry variable reluctance pickup system having a single sensing face.

FIG. 5 is partial top view of the invented variable reluctance pickup illustrating a "bending" motion.

FIG. 6 is a cross-section view taken along lines 6 — 6 of FIG. 4.

FIG. 7 is a graph showing signal output as a function of position across the pickup shown in FIG. 4.

DESCRIPTION OF PREFERRED EMBODIMENT

Referring to FIG. 1, the invented single face, high asymmetry variable reluctance pickup has a single permanent bar magnet 11 mounted on a printed circuit board 12. The bar magnet 11 may be composed of a ceramic material. The pickup shown in FIG. 1 is designed to have the polarity axis 13 of the bar magnet 11 aligned parallel to the instrument strings. Rectangular core elements 14 are mounted on the opposite long sides (opposite poles) of the bar magnet 11. The core elements 14 are composed of a magnetically susceptible material. The core elements 14 are positioned in a staggered relationship with each other across the bar magnet 11. Planar shaping faces 15 are mounted or positioned on the top ends of the core elements 14. The shaping faces 15 are composed of a magnetically susceptible material.

The bar magnet 11, the core elements 14 and the shaping faces 15 provide a shaped magnetic field region designed to encompass the string plane of a steel string musical instrument. Specifically, the bar magnet 11 is the source of the magnetic field. The core elements 14 magnetically couple the shaping faces 15 to bar magnet 11. The shaping faces spread the magnetic field over their planar surfaces.

Sensing coils 16 are wound around the core elements 14 in a section between the shaping faces 15 and the bar magnet 11. The sensing coils sense changes in reluctance in a magnetic circuit formed by the vibrating strings of the musical instrument, the shaping faces 15, the core elements 14, and the bar magnet 11.

In more detail, the shaping faces 15 phenomenologically shape the magnetic field emanating from the bar magnet 11 to provide a maximum magnetic flux gradient perpendicular to the string plane and a minimum magnetic flux gradient parallel to the string plane. Referring to the cross-sectional view of the pickup shown in FIG. 2, the lines 19 depict lines of equal magnetic field strength (magnetic field lines). The magnetic field lines depicted in FIG. 2 represent the summation of the magnetic field across the aperture of the invented pickup. The aperture of a variable reluctance pickup is, for purposes of this application, defined as the length of the instrument's strings 18 which operatively form the magnetic circuit in combination with the shaping faces 15, core elements 14 and bar magnet 11.

As is illustrated by the lines of equal magnetic field strength 19 shown in FIG. 2, there is essentially no change in the magnetic field strength in a plane parallel to the surface of the shaping faces 15 (parallel the string plane). However, there is a change in the magnetic field in a direction perpendicular to the plane of the shaping faces 15 (perpendicular to the string plane). Thus, an instrument string 18 vibrating perpendicular to the string plane (perpendicular to the plane of the shaping faces 15) will cross a large number of field lines 19 to generate a corresponding large change of reluctance in the magnetic circuit, which change in reluctance, in turn, generates a large electrical signal. However, a string vibrating parallel to the string plane, (parallel to the plane of the shaping faces 15) will cross relatively few, if any, field lines 19 to generate a corresponding small change of reluctance in the magnetic circuit which, in turn, generates a small electrical signal in the sensing coils 16. Accordingly, the described pickup asymmetrically or preferentially generates a signal responsive to changes in the string 18 position in a plane perpendicular to the string plane.

The shaping faces 15 also spread the magnetic field provided by the bar magnet 11 uniformly across the string plane. Referring to FIG. 3, the magnetic field strength is shown as a function of position in the string plane above a variable reluctance pickup. The dots 21 along the abscissa of FIG. 3 represent the quiescent string position in the string plane. (The strings are extending perpendicularly from the plane of the figure.) Curve I depicts the magnetic field strength in the string plane provided by the invented pickup. Curve II depicts the magnetic field strength in the string plane provided by a conventional prior art pickup with individual pole pieces for each string. As is illustrated, Curve I is essentially flat, whereas Curve II shows a drop-off of magnetic field in the regions between the quiescent string positions 21.

The spreading of the magnetic field uniformly across the string plane allows "bending" without loss of signal. Specifically, there is no drop-off in the magnitude of the changes of reluctance generated by a vibrating string as it is moved from its normal vibrating zone about its quiescent position during the "bending" motion. Moreover, both FIGS. 2 and 3 illustrate that the invented pickup preserves its asymmetrical conversion of string vibration to electrical signals during a "bending" motion.

In the single face, variable reluctance pickup shown in FIGS. 1 and 2, the sensing coils 16 are electrically connected in series in a conventional "humbucking" arrangement. The conductive strips 17 on the printed circuit board 12 provide the electrical connection between the sensing coils 16. The term "humbucking" is a descriptive term in the art describing a condition whereby sensing coils of the pickup are connected such that signals in the coils generated by external electric fields cancel out. Such signals, if not cancelled out, would generate hum in the ultimate acoustic output after amplification.

Specifically, changes in reluctance in the magnetic circuit produced by string vibrations generate electrical signals in the coils 16 at the opposite poles of the bar magnet 11 of the same polarity, whereas an external electric field will generate electrical signals of opposite polarity in the sensing coils on opposite poles of the bar magnet 11. The signals of opposite polarity cancel out whereas the signals of the same polarity add together.

In FIG. 2, the four sensing coils 16*a*, *b*, *c*, and *d*, each have an inside lead and an outside lead. The inside lead of coil 16*a* is electrically connected to the positive input of the amplifier system and its outside lead is electrically connected to the inside lead of coil 16*b*. The outside lead of coil 16*b* is connected to the outside lead of coil 16*c* on the opposite side (opposite polarity) of the bar magnet. The inside lead of coil 16*c* is then electrically connected to the outside lead of coil 16*b* and the inside lead of coil 16*d* is electrically connected to the negative input of the amplifier system. In essence, the coils 16*a* and 16*b* are wound in an opposite direction than coils 16*c* and 16*d*. Accordingly, an external electric field will generate an electrical signal in coils 16*a* and 16*b* of one polarity while generating an electrical signal in coils 16*c* and 16*d* of opposite polarity and the summed electrical signal output of the coils 16*a* – *d* is zero. However, since the coils 16*a* and 16*b* are sensing changes of reluctance of one polarity and coils 16*c* and 16*d* are sensing changes of reluctance of the opposite polarity, and since the coils 16*a* and 16*b* are wound in an opposite direction than the coils 16*c* and 16*d*, the coils 16*a* and 16*b* will generate an electrical signal of the same polarity as those generated by coils 16*c* and 16*d* responsive to a change of reluctance in the magnetic circuit. Thus, it can be seen that a "conventional humbucking arrangement" requires an equal number of sensing coils 16 on each side (each pole) of the bar magnet 11.

FIG. 4 shows another embodiment of a single face, high asymmetry variable reluctance pickup which includes a single permanent bar magnet 22 having a north-south polarity axis oriented perpendicularly with respect to the string plane as indicated by the arrow 21. The bar magnet 22 may be composed of a ceramic material or other material capable of being permanently magnetized. A single core element 23 composed of magnetically susceptible material is mounted on one pole of the bar magnet 22. A planar shaping face 24 also composed of a magnetically susceptible material is secured to the opposite end of the core element 23. When the pickup, shown in FIG. 4, is mounted in a string instrument, the rectangular surface area of the shaping face 24 is proximate the string plane of the instrument. The long sides of the shaping face 24 are positioned perpendicularly with respect to the instrument strings. The plane of the rectangular face of the shaping face 24 is parallel the string plane. The magnetic circuit is formed by the bar magnet 22, the core element 23 and the shaping face 24 in combination with the instrument strings 25. (See FIG. 6). A sensing coil 26 is wound around the core element 23 in the space between the shaping face 24 and the top surface of the bar magnet 22.

The shaping face 24 shapes the magnetic field region in the string plane to provide a maximum magnetic flux gradient in a direction perpendicular to the string plane and a minimum magnetic flux gradient in a direction parallel the string plane. The shaping face also spreads the magnetic field region uniformly across the width of the string plane. Accordingly, the pickup asymmetrically or preferentially converts the vertical displacements of the instrument strings 25 into an electrical signal. Also, the asymmetrical or preferential conversion does not abate or drop off during a "bending" motion of a particular instrument string 25. In particular, referring to FIG. 5, a string 25 can be moved from a vibrating position about its normal quiescent position 27 to a vibrating position 28 shown by the dotted line during a "bending" motion without loss or drop-off of signal.

The invented single face, variable reluctance pickup heretofore has been discussed in context of planar or flat string planes. However, many string instruments are constructed with a curved string plane. In instruments having a curved string plane, it is possible to provide a signal output curve from the pickup which corresponds to the curvature of the string plane.

Specifically, in the embodiment of the invented single face, variable reluctance pickup shown in FIG. 4, it is possible to determine the "curvature of signal response" by varying the length of the core element 23 and the thickness of the shaping face 24. The "curvature of signal response" from the pickup is the curve defined by the magnitude of electrical signals from the coil or coils as a function of position along the length of the shaping face. (See FIG. 7). The length of the core element 23 also determines the diameter of the sensing coil 26. (As pointed out previously, a smaller mean radius of the sensing coil reduces the impedance of the coil, hence, enhancing its high-frequency response.)

It has been found, generally, that the curvature of signal response is inversely related to the thickness (T) of the shaping face 24 and inversely related to the length (L) of the core element 23. For a shaping face 24 of a given length, a thicker shaping face will allow a shorter core element with the same resulting curvature. Referring to the graph of FIG. 7, the horizontal ordinate shows the respective ends and center line of the embodiment of the invented pickup shown in FIG. 4. The vertical ordinate designates the magnitude of the output signal generated by the pickup. The curve 29 gives the curvature of the pickup, i.e., gain versus position along the length of the pickup. The circles 30 in FIG. 7 designate the square of the distance measured from the quiescent string positions to a reference plane through the coil 20 parallel the top surface of the magnet 22.

It is not possible to define the exact relationship between the curvature of signal response of the pickup, the core element length L and the pole tip thickness T. Specifically, the width of the string plane and the curvature of the string plane are determined by the instrument construction and each instrument type would have a different width and curvature. In general, however, the shaping face 24 and bar magnet 22 should have a length at least equal to the width of the instrument's string plane. The curvature of signal response can then be adjusted for the curvature of the string plane by measuring the output from the sensing coil as a function of position along the length of the shaping face 24 and of either the thickness T of the shaping face 24 or the length L of the core element 23 or both.

The curvature of signal response of the pickup structure shown in FIG. 1 can be adjusted to the curvature of the string plane by varying the spacing between the core elements 14 in addition to varying the core lengths and shaping face thickness as previously discussed. Generally, the curvature of signal response is inversly related to core element spacing.

The structures shown in FIGS. 1 and 4 are potted in an insulative epoxy 31. The epoxy 31 forms a rigid matrix for holding the separate elements of the pickup in a fixed relationship to one another. In addition, the epoxy matrix 31 greatly increases the durability of the described pickups.

While the invented single face, high asymmetry variable reluctance pickup for steel string musical instruments is described with respect to particular embodiments, schematics and the like, numerous variations and modifications can be effected within the spirit and the scope of the invention as described above and as defined as set forth in the appended claims.

I claim:

1. In vibrating string musical devices which have a plurality of parallel strings composed of magnetically susceptible materials, said strings being oriented in a common string plane, a variable reluctance pickup for asymmetrically sensing vibrations of strings and generating corresponding electrical signals responsive thereto, comprising in combination, means for forming a magnetic circuit in combination with a linear segment of each string including, means for shaping a single magnetic field region having a magnetic flux gradient in a vertical direction (v) perpendicular to said string plane and perpendicular to said strings ($d\,\Phi/dv$) for producing large changes of reluctance in said magnetic circuit responsive to motions of said linear segments of said strings in said vertical direction, and having a very small magnetic flux gradient in a horizontal direction (h) perpendicular to said strings and parallel to said string plane ($d\,\Phi/dh$) where ($d\,\Phi/dh$) << ($d\,\Phi/dv$), for producing very small changes of reluctance in said magnetic circuit responsive to motions of said linear segments of said strings in said horizontal direction, said shaped magnetic field region encompassing all said linear segments of said strings, and sensing means for sensing changes of reluctance in said magnetic circuit and producing representative electric signals responsive thereto, said sensing means being adapted for electrical connection, whereby the electrical signals produced by said sensing means can be electronically amplified and then converted into corresponding acoustical waves.

2. The variable reluctance pickup of claim 1 wherein said means for forming a magnetic circuit in combination with a linear segment of each string further includes, a longitudinal magnetic element providing a magnetic field, said magnetic element having a north and a south side providing a corresponding north-south polarity axis oriented perpendicularly with respect to its longitudinal axis, said magnetic element being oriented with its longitudinal axis aligned perpendicular to and with its north-south polarity axis aligned parallel to said linear segments of said strings, said magnetic element being disposed proximate said string plane, and a plurality of separate core elements composed of a magnetically susceptible material, said plurality of core elements being divided into north and south sets of core elements, said north set of core elements being disposed contiguous to said north side of said magnetic element and said south set of core elements being disposed contiguous to said south side of said magnetic element, said core elements extending from said magnetic element toward said string plane whereby an efficient magnetic flux coupling between said linear segments of said string and said magnetic element is established.

3. The variable reluctance pickup of claim 2 wherein the number of core elements in said north set of core elements equals the number of core elements in said south set of core elements, and each core element in said north set of core elements is positioned on said north side of said magnetic element opposite a space on said south side of said magnetic element defined between two adjacent core elements in the south set of core elements.

4. The variable reluctance pickup of claim 3 wherein each core element has a planar end proximate the string plane parallel said strings, and wherein said means for shaping a magnetic field region encompassing said linear segments of said strings comprises, a longitudinal north shaping face composed of a magnetically susceptible material, said north shaping face being mounted on said ends of said north set of core elements, said longitudinal north shaping face being oriented perpendicularly with respect to said polarity axes, and a longitudinal south shaping face composed of a magnetically susceptible material, said south shaping face being mounted on said ends of said south set of core elements, said longitudinal south shaping face also being oriented perpendicularly with respect to said polarity axes whereby magnetic flux emanating from said magnetic element through said core elements is spread uniformly across the surface of said north and south shaping faces.

5. The variable reluctance pickup of claim 4 wherein said string plane of said vibrating string musical device has a width measured perpendicularly with respect to said strings, and wherein said length, of said magnetic element, of said north shaping face and of said south shaping face, respectively, are at least equal to said width of said string plane.

6. The variable reluctance pickup of claim 5 wherein said north and south shaping faces each have a rectangular-like planar surface proximate said string plane, said planar surfaces being oriented in the same plane and parallel said strings with said respective lengths oriented perpendicularly with respect to the polarity axis of said magnetic element.

7. The variable reluctance pickup of claim 6 wherein the length of the linear segments of each string encompassed by the shaped magnetic field is defined as the aperture of the pickup and wherein in a reference plane perpendicular to and bisecting said aperture, said shaped magnetic field has lines of equal magnetic field strength of a rectangular-like configuration having a length dimension approximately equal to said length of said north and south shaping faces.

8. The variable reluctance pickup of claim 7 wherein said sensing means for sensing changes of reluctance in said magnetic circuit comprises a plurality of coils formed of insulated conductive wire, each of said coils being disposed around one of said core elements for generating representative electrical signals responsive to changes of reluctance in said magnetic circuit, said coils being electrically connected in series, said serially connected coils being adapted for electrical connection whereby electrical signals generated by said coils can be electronically amplified and then converted into corresponding acoustical waves.

9. The variable reluctance pickup of claim 8 wherein said magnetic element is insulatively mounted on a printed circuit board and wherein said printed circuit board has a plurality of conductive strips for electrically connecting said sensing coils in series.

10. The variable reluctance pickup of claim 9 wherein said sensing coils are wound around said core elements in a section defined between said shaping faces and a surface of said magnetic element nearest said string plane.

11. The variable reluctance pick-up of claim 10 further defined in that said coils are electrically connected for cancelling electrical signals generated in said coils by external electrical fields.

12. The variable reluctance pickup of claim 21 wherein said means for forming a magnetic circuit in combination with a linear segment of each string further includes, a longitudinal magnetic element providing a magnetic field, said magnetic element having a north-south polarity axis oriented perpendicularly with respect to its longitudinal axis, said magnetic element being disposed proximate said string plane with said longitudinal axis and said north-south polarity axis both oriented perpendicularly with respect to said strings, said magnetic element further having a planar top surface nearest said strings, and a core element composed of magnetically susceptible material mounted on top of said planar surface of said magnetic element and extending toward said strings whereby an efficient magnetic flux coupling between said magnetic element and said linear segment of said strings is established.

13. The variable reluctance pickup of claim 12 wherein said core element has a length less than said length of said magnetic element, and wherein said core element has a planar end surface parallel said top surface of said magnetic element.

14. The variable reluctance pickup of claim 13 wherein said means for shaping said magnetic field region encompassing said linear segments of said strings comprises a shaping face composed of a magnetically susceptible material, said shaping face being positioned on said planar end surface of said core element and wherein said shaping face has a thickness and a surface proximate said strings, said surface having a rectangular-like figuration with a length at least equal to the length of said magnetic element, whereby a magnetic field region is provided which has a maximum magnetic flux gradient in a direction perpendicular to said string plane and perpendicular to said strings which has a minimum magnetic flux gradient in a direction perpendicular to said strings and parallel to said string plane.

15. The variable reluctance pickup of claim 14 wherein said string plane has a width measured perpendicularly with respect to said strings and wherein said lengths of said shaping face and said magnetic element respectively at least equal said width of said string plane.

16. The variable reluctance pickup of claim 15 wherein said sensing means for sensing changes of reluctance in said magnetic circuit comprises a coil formed of insulative conductive wire wound around said core element for generating representative electrical signals responsive to changes of reluctance in said magnetic circuit, said coil being adapted for electrical connection whereby said electrical signals generated by said coil can be electronically amplified and then converted into corresponding acoustical waves.

17. The variable reluctance pickup of claim 16 wherein said string plane has a curvature and said shaping face has a thickness dimension T and said core element has a length dimension L, and wherein the length of the core element and the thickness of the shaping face are such that the magnitude of electrical signals from the coil measured as a function of position along the length of said shaping face traces a curve with a curvature corresponding to a curvature of a curve defined by squaring distances measured between each string and a reference plane through the coil parallel the top surface of the magnetic element.

18. The variable reluctance pickup of claim 11 wherein said printed circuit board, said magnetic element, said core elements, said sensing coils, and said shaping faces are potted in an insulative epoxy matrix.

19. The variable reluctance pickup of claim 17 wherein said magnetic element, said core element, said coil and said shaping face are potted in an insulative epoxy matrix.

20. The variable reluctance pickup of claim 11 wherein said string plane has a curvature, said north and south shaping faces have a thickness dimension T, said plurality of core elements each have a length dimension L measured parallel the length of said shaping faces and the core elements of said north set and of said south set are spaced a distance D apart, and wherein the length of the core elements L, the thickness of the shaping faces T and spacing distance D between the core elements of said north set and of said south set are such that the magnitude of electrical signals from the sensing coils measured as a function of position along the length of said shaping faces traces a curve with a curvature corresponding to a curvature of a curve defined by squaring distances measured between each string and a reference plane through said coils parallel said shaping faces.

21. In vibrating string musical devices which have a plurality of parallel strings composed of magnetically susceptible materials, said strings being oriented in a common string plane, a variable reluctance pickup for asymmetrically sensing vibrations of strings and generating corresponding electrical signals responsive thereto, comprising in combination, means for forming a magnetic circuit in combination with a linear segment of each string including, means for shaping a single magnetic field region having a magnetic flux gradient in a vertical direction (v) perpendicular to said string plane and perpendicular to said strings ($d\Phi/dv$) for producing large changes of reluctance in said magnetic circuit responsive the motions of said linear segments of said strings in said vertical direction, and having a very small magnetic gradient in a horizontal direction (h) perpendicular to said strings and parallel to said string plane ($d\Phi/dh$) where ($d\Phi/dh$) approaches zero, ( ($d\Phi/dh$) 0), for producing very small changes of reluctance in said magnetic circuit responsive to motions of said linear segments of said strings in said horizontal direction, said shaped magnetic field region encompassing all said linear segments of said strings, and sensing means for sensing changes of reluctance in said magnetic circuit and producing representative electical signals responsive thereto, said sensing means being adapted for electrical connection, whereby the electrical signals produced by said sensing means can be electronically amplified and then converted into corresponding acoustical waves.

* * * * *